US009114496B2

(12) United States Patent
Saunders et al.

(10) Patent No.: US 9,114,496 B2
(45) Date of Patent: Aug. 25, 2015

(54) METHOD OF TIP GRINDING THE BLADES OF A GAS TURBINE ROTOR

(75) Inventors: Duncan Saunders, Derby (GB); Kevin Jones, Belper (GB); Martin S. Suckling, Derby (GB)

(73) Assignee: ROLLS-ROYCE plc, Derby (GB)

( * ) Notice: Subject to any disclaimer, the term of this patent is extended or adjusted under 35 U.S.C. 154(b) by 687 days.

(21) Appl. No.: 13/350,114

(22) Filed: Jan. 13, 2012

(65) Prior Publication Data

US 2012/0202405 A1 Aug. 9, 2012

(30) Foreign Application Priority Data

Feb. 4, 2011 (GB) ..... 1101909.8
Feb. 16, 2011 (GB) ..... 1102675.4

(51) Int. Cl.
*B24B 19/14* (2006.01)
*B24B 1/00* (2006.01)

(52) U.S. Cl.
CPC .. *B24B 1/00* (2013.01); *B24B 19/14* (2013.01)

(58) Field of Classification Search
CPC ..... B24B 1/00; B24B 19/14
USPC ..... 451/54; 269/21, 20, 903; 29/281.1, 29/289.23, 889.7
See application file for complete search history.

(56) References Cited

U.S. PATENT DOCUMENTS 4,501,095 A * 2/1985 Drinkuth et al. ..... 451/5
4,512,115 A * 4/1985 Miller ..... 451/49
5,456,576 A * 10/1995 Lyon ..... 415/173.3
5,667,359 A * 9/1997 Huber et al. ..... 416/96 A
6,363,612 B1 4/2002 Roberts et al.
6,855,033 B2 * 2/2005 Jones et al. ..... 451/28
2004/0171330 A1 * 9/2004 Whitmarsh et al. ..... 451/28
2007/0048142 A1 * 3/2007 Dambrine et al. ..... 416/219 R
2007/0084053 A1 * 4/2007 Piccioni ..... 29/889.23
2010/0111700 A1 * 5/2010 Kim et al. ..... 416/219 R
2012/0210579 A1 * 8/2012 Stone ..... 29/889.21

FOREIGN PATENT DOCUMENTS

DE 34 02 066 A1 8/1985
DE 3402066 A1 * 8/1985
DE 199 21 198 C1 6/2000
EP 0 040 467 A1 11/1981
EP 1491 289 A1 12/2004
GB 2 142 564 A 1/1985

OTHER PUBLICATIONS

British Search Report dated Oct. 10, 2011 issued in British Application No. 1101909.8.
British Search Report dated Jun. 6, 2011 issued in British Application No. 1102675.4.

* cited by examiner

*Primary Examiner* — Monica Carter
*Assistant Examiner* — Marcel Dion
(74) *Attorney, Agent, or Firm* — Oliff PLC

(57) ABSTRACT

A method of grinding the tip of a blade which forms part of a rotor for a gas turbine engine is provided. The method includes mounting a plurality of blades in a disc to provide a blade assembly; mounting the blade assembly in a grinding apparatus; aligning the plurality of blades in a predetermined position using compressed fluid; and, grinding the blade tips.

8 Claims, 3 Drawing Sheets

METHOD OF TIP GRINDING THE BLADES OF A GAS TURBINE ROTOR

This invention relates to a method of manufacturing the blades of a rotor for a gas turbine engine. In particular, this invention relates to a method of grinding the tips of compressor blades.

FIG. 1 shows a typical three shaft gas turbine engine 10. The gas turbine engine 10 includes an air intake 12, a fan 14 having rotating blades 16, a bypass duct 18 and an engine core 20. The engine core 20 includes an intermediate pressure compressor 22, a high pressure compressor 24, a combustor 26, a turbine arrangement comprising a high pressure turbine 28, an intermediate pressure turbine 30, a low pressure turbine 32 and an exhaust nozzle 34. Air entering the intake 12 is accelerated by the fan 14 and directed into two air flows. The first air flow passes into the engine core 20, and the second air flows along the bypass 18 to provide propulsive thrust.

The engine core air flow travels through the intermediate 22 and high 24 pressure compressors in turn. The compressed air exhausted from the high pressure compressor 24 is mixed with fuel and burnt in the combustor 26. The hot gas expands through and drives the high 28, intermediate 30 and low 32 pressure turbines before being exhausted through the nozzle 34 and adding to the propulsive thrust created by the first air flow. The high 28, intermediate 30 and low 32 pressure turbines respectively drive the high 24 and intermediate 22 pressure compressors and the fan 14 via respective shafts 36, 38, 40.

It is well known that to maintain an efficient gas turbine engine the gap between compressor blade tips and the engine casing is closely controlled to minimise the leakage of compressed air over the blade tips and back upstream. To this end, the engine casings often include an abradable liner which provides a close fitting seal with the blade tips.

The abradable liner is initially installed so as to be in contact with the compressor blade tips. During the first few rotations of the compressor rotors, the abradable liner is scored by the rotating fan and compressor blade tips which remove just enough material to allow a free rotation of the compressor blades whilst maintaining a close gap.

During engine use, the radial position of the rotating blade tips move due to thermal expansion and vibration. This causes the blade tips to rub on the abradable liner, so-called tip rub, which generally results in a greater degree of upstream air leakage and a reduction in efficiency.

This invention seeks to reduce tip rub.

In a first aspect, the present invention provides a method of grinding the tip of a blade which forms part of a rotor for a gas turbine engine, comprising: mounting a plurality of blades in a disc to provide a blade assembly; mounting the blade assembly in a grinding apparatus; aligning the plurality of blades in a predetermined position using compressed fluid; and, grinding the blade tips.

Aligning the blades in a predetermined position ensures that the blades are uniformly ground relative to each other which prevents any accumulative errors between blades. Using compressed fluid provides an automated way of implementing the alignment which is readily repeated if the grinding process needs to be halted and restarted for any reason. For example, if a blade needs to be changed during the grinding process.

The predetermined position is the same for each of the blades. Preferably, the predetermined position is a tilt position which is determined by an amount of movement which occurs between the rotor blade assembly and the disc.

The alignment of the blades can be carried out whilst the blade assembly is rotated in the grinding apparatus. The alignment can be carried out prior to a grinding speed rotation and by hand if necessary. That is, rotating the rotor blade arrangement at a few rotations per minute allows the blades to be aligned without hindrance from centrifugal stiction. Further, it means that the compressed fluid can be applied from a fixed position relative to the grinding apparatus.

The blade can have a pressure surface. The blade can have a suction surface. The compressed fluid can be incident on either the pressure surface or suction surface. Preferably, the blade is a compressor blade for a gas turbine engine.

The compressed fluid is used to push the blades into the predetermined position. The skilled person will appreciate that any suitable fluid can be used for this purpose. For example, the fluid may be a liquid. The liquid can be cutting fluid. Although the blade grinding technique described in the embodiment below is a dry grinding technique, the skilled person will appreciate that the use of cutting fluid can be advantageous where it is already present in a grinding apparatus.

The compressed fluid can be a gas. Preferably, the compressed fluid is air.

The compressed fluid can be at a pressure sufficient to apply a force of between approximately 1N to 20N on the blade. Preferably, the force will be in the range of 10N to 15N. The skilled person will appreciate that the amount of force will be dependant on the pressure of the air and the position of the nozzle relative to the blade, as well as the shape and size of the blade.

The blade can be a compressor blade for a gas turbine engine. The blade can incorporate an aerofoil. The aerofoil can have a radial length between 20 mm to 150 mm.

The pressure of the compressed air can be in the range of approximately 0.25 MPa to 1 MPa. Preferably, the pressure will be in the range of approximately between 0.4 MPa to 0.8 MPa.

There may a plurality of nozzles. The plurality of nozzles may be distributed over a surface of a blade.

Each of the plurality of blades can be mounted to the disc via a root portion held within a slot in a circumferential portion of the disc.

In a second aspect, the present invention provides a method of grinding the tip of a blade which forms part of a rotor for a gas turbine engine, comprising: mounting a plurality of blades in a disc to provide a blade assembly; positioning the blades in a predetermined position; adhering the blades to the disc so as to retain them in the predetermined position; mounting the rotor blade assembly in a grinding apparatus; and, grinding the blade tips.

The use of an adhesive fixes the blades in position whilst the rotor blade assembly is sped up to and slowed down from the grinding rotational speed. The skilled man will appreciate that the blades are located in a fixed position at these higher rotational speeds via centrifugal stiction and so no fixing is required.

Preferably, the adhesive is an epoxy resin. The adhesive can be a high temperature adhesive which can withstand the operating temperature of the compressor stage in which the rotor is located.

The method according to the second aspect can further comprise the steps of: balancing the blades; and, applying a protective coating to the blades which protects the blades from debris generated during the grinding process, wherein the adhesive is applied to the blade arrangement after the blades have been balanced and before the application of the protective coating.

In a third aspect, the present invention provides a grinding apparatus for grinding the tip of a blade which forms part of a rotor for a gas turbine engine, the grinding apparatus comprising: a mount for holding the rotor blade assembly; an abrasive member for grinding the tip of the blade; a nozzle in fluid communication with a source of compressed fluid, wherein the nozzle can be adapted to project the compressed fluid onto each of a plurality of blades of the blade assembly so as to position each blade in a predetermined position relative to the rotor blade assembly.

The nozzle can be adapted to project fluid onto a pressure surface or suction surface of the blade.

The plurality of blades of the rotor blade assembly can each be mounted in a slot provided in a disc of the rotor blade assembly.

The compressed fluid can be cutting fluid. Preferably, the compressed fluid is air.

An embodiment of the invention will now be described with the aid of the accompanying drawings in which.

Figure 4A:
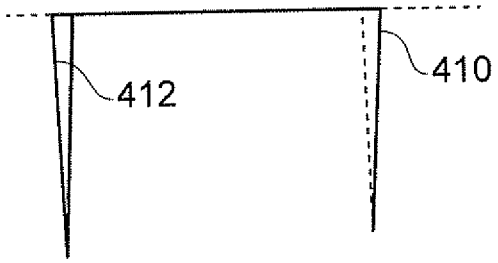

FIG. 4*a* shows a ground profile of two blades resting in two positions during the grinding process.

Figure 4B:
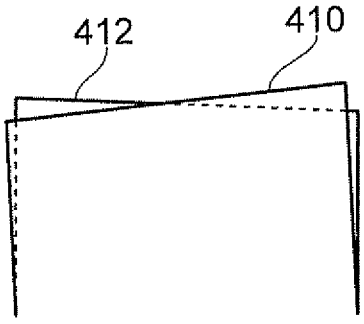

FIG. 4*b* shows the ground blades of 4*a* with resting positions swapped during a period of use.

Figure 5:
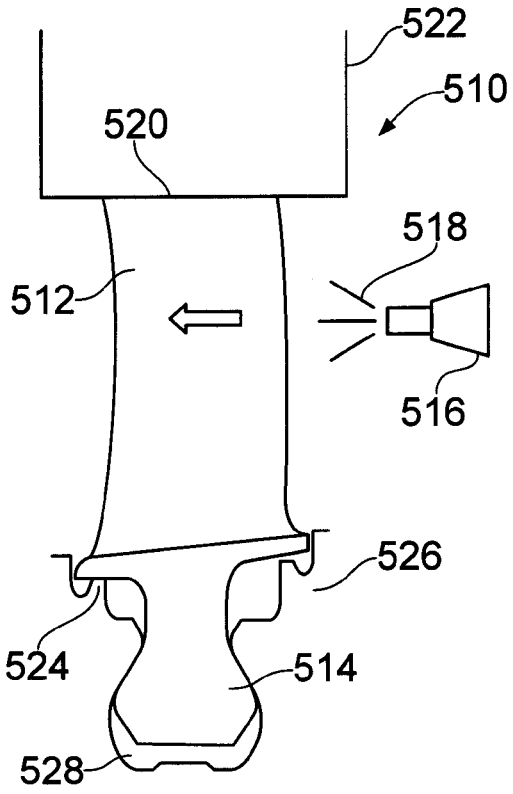

FIG. 5 shows an embodiment of the invention which uses compressed fluid to align the blades.

Figure 6:
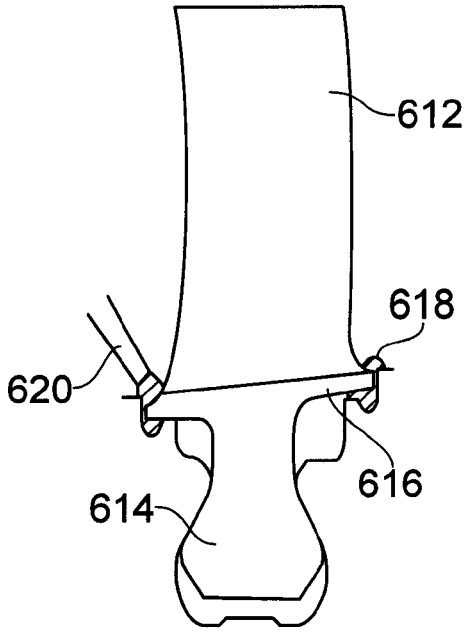

FIG. 6 shows an embodiment of the invention in which an adhesive is used to fix the blades in place.

There are principally two main types of compressor blade root construction: axial root and circumferential root. The problem identified by the applicants and described below is with reference to circumferential rooted blades, but can be applied to other forms of blade root such as axial roots where appropriate.

As stated above it is imperative to the effectiveness of a modern gas turbine engine to maintain a closely controlled, minimal gap between the tips of the compressor blades and engine casing. To this end, it is standard engineering practice to include a circumferential abradable liner as part of the engine casing which is in contact with and rubbed by the compressor blades during use. The abradable nature of the liner allows it to be sculpted by the blade tips to provide a tailored and close fit.

During normal operation of the engine the radial position of compressor blade tips move due to vibration and thermal expansion of the compressor rotors and engine casing. This movement further rubs the abradable liner such that the mean operating gap between the blade tips and liner increases over time. This increases the leakage of air back up the compressor, thereby reducing efficiency and performance of the engine.

Figure 1:
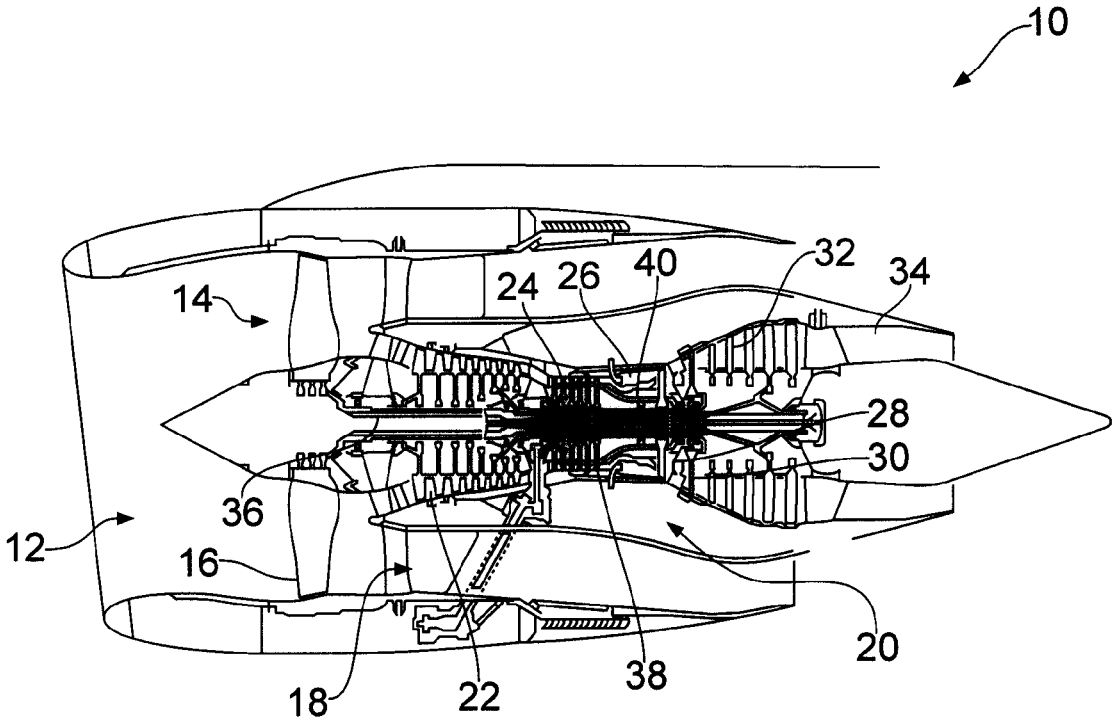
FIG. 1 Related Art
FIG. 1 shows a schematic cross section of a conventional gas turbine engine which is not part of the invention and is included for understanding the invention only.
Figure 2:
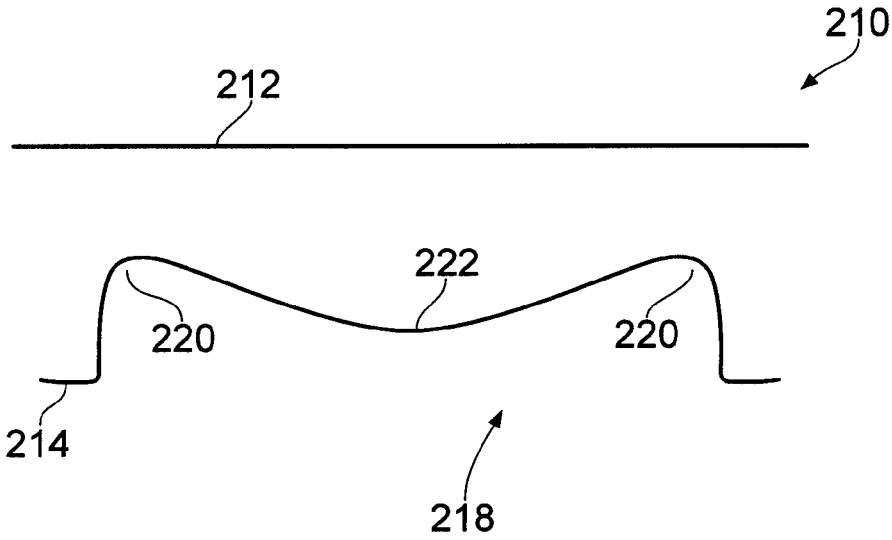
FIG. 2 Related Art
FIG. 2 shows a typical abradable liner tip rub profile.

FIG. 2 shows a typical but exaggerated profile of an abradable liner 210 caused by compressor blade tip rub over time. The liner includes an outer surface 212 which is attached to the engine casing and an inner surface 214 which faces the rotor. In use, the blade rotates about the rotor axis, travelling in a direction perpendicular to the page, so as to contact and rub the liner. The profile of the rub 218 can be generally described as "M" shaped where the extent of the rub is greater towards the edges 220 of the rotational path of the blades than in the mid portion 222. Although the exact profile of the rub will change between rotors and engines, the "M" shaped profile is a generally a reasonably common occurrence.

During manufacture of the rotors, the blades undergo a grinding process in which a blade assembly is rotated such that the tips of the blades pass a rotating grinding wheel which removes a portion of the blade. Typically, approximately one to two millimeters is removed from each blade tip with the grinding controlled such that the peak to peak height difference between leading and trailing edges of blade tip is typically less than 0.1 mm. In this way, the positions of the each of the blade tips can be controlled during rotation such that the erosion of the abradable liner is minimised.

Figure 3:
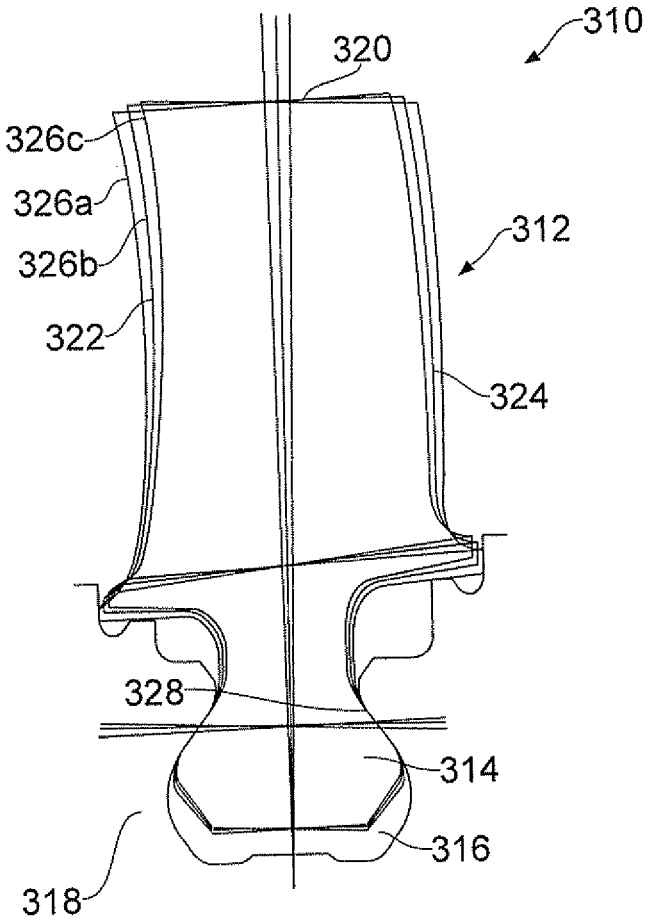
FIG. 3 shows the three tilt positions in which a blade can rest within a disc.

In FIG. 3 there is shown a cross section of an intermediate compressor rotor 310 having a blade 312 with a circumferential root 314 which is snugly received within a slot 316 in a disc 318. The blade includes a tip 320, a leading edge 322 and a trailing edge 324.

There is a degree of movement provided between the blade root 314 and disc slot 316 in order for the blades to be slotted into place. This allows the blade. 312 to rest in different positions within the rotor as shown by the positions indicated by reference numeral 326*a*, the second by 326*b* and the third by 326*c*. The second position 326*b* represents the mid point of the blade 312 within the slot 316 with the other two positions demonstrating the range of movement.

During use, the rotor is rotated at several thousand rpm which results in a radial centrifugal force acting on the blade 312. This results in a stiction between the shoulder of the root 328 and corresponding opposing surface of the slot 316, which keeps the blade 312 in a fixed position. It has been previously known that blades can move when the rotor 310 slows to a halt and the centrifugal force that locks the blades in place no longer applies. Thus, when in service, the blade 312 may fall into one or other of the extreme positions where they will remain until the engine is next started.

The above sequence of events leads to the movement of the blade and the different tilt positions leads to the tips of the blades being higher or lower in relation to the abradable liner. This results in the "M" shaped profiled in the liner. However, the applicants have discovered that the extent of the "M" profile is greater than could be explained by the movement of the blades in this way and the tolerances measured from the tip grinding, which is taken to be accurate.

Upon investigation, the applicant's have discovered that the blades held within a blade assembly for grinding can and were moving prior to the grinding operation, particularly when the grinding process is stopped part way through and restarted as is sometimes necessary if a blade is damaged and needs replacing. If one or more of the blades does move during this process, for example, from position 326*a* to position 326*c* as shown in FIG. 3, then the profile created by the grinding process is effectively skewed.

If the position of a blade alters during the grinding process then they will have different profiles with respect to one another. FIG. 4*a* shows a pair of blades 410, 412 which have moved during the grinding process and are no longer aligned. Although the grinding of the blade tips is well controlled such that the tip variance between blades is less than 100 microns, the different positions of the blades 410, 412 are not accounted for. Hence, as shown in FIG. 4*b*, if the blades 410, 412 move relative to the disc during service of the engine e.g. when the rotor comes to rest after a period of use, the blades 410, 412 can swap tilt positions and the error which would ordinarily be expected is doubled. The skilled reader will appreciate that the actual difference this leads to is in the order of 100's of microns and FIG. 4*b* is not to scale.

Prior to the applicant discovering the tilt phenomena occurring during grinding, particularly if the process is stopped, the grinding process was considered to be well monitored, accurate and reliable.

FIG. 5 shows an arrangement 510 of the first embodiment of the invention in which the blade 512 is mounted in a disc via the blade root 514 which is slotted into a bucket groove 528 to provide a blade assembly. The blade assembly is mounted in a grinding apparatus via a rotatable mount and a nozzle 516 located adjacent to the blade 512. The nozzle 516 is in fluid communication with a source of compressed fluid such as compressed air 518. The nozzle 516 can be adapted to blow the compressed air 518 onto each of the blades of the blade assembly when it is rotated so as to position each blade in a predetermined position relative to the blade assembly and grinding apparatus. The predetermined position can be chosen in accordance with a given application but would typically be one of the tilt positions 326*a* or 326*b* as shown in FIG. 3. In this embodiment, the predetermined position is provided by the underside of the blade platform and projection 524 which is an integral part of the disc. However, the skilled person will appreciate that other predetermined positions may be preferable depending on the blade and disc arrangement in question.

The grinding wheel 522 is a rotatable abrasive member which is located above the blade tip 520.

The nozzle is approximately between 5 mm and 20 mm away from the blades. The compressed air supplied by the nozzle is around 27 kPa which is sufficient to move provide a force of between approximately 1 and 10N on the blade. The skilled person will appreciate that the air pressure required will depend on the blade arrangement and the position of the nozzle etc. However, the air pressure need not be particularly high as the air only fixes the blade in position whilst the speed of rotation increases.

In use, a plurality of blades 512 are mounted in the disc 526 and the assembly mounted in the grinding apparatus. Prior to the grinding process starting, the blade assembly is slowly rotated by hand and compressed air 518 from the nozzle 516 directed on to either the pressure surface or suction surface of the blade which, due to the chordal twist in the blade, results in the blade being pushed into the predetermined position defined by the blade platform and projection 524. Once the blades 512 have all been urged into position, the speed of rotation is increased and the centrifugal force retains the blade 512 in the chosen position during the grinding process. Hence, the compressed air flow is stopped after a predetermined rotational speed is reached.

If a blade is damaged during the grinding process and needs to be changed then the process described above is repeated.

A second solution to the tilting problem during the grinding process is provided with the embodiment shown in FIG. 6. Here the blades 612 are held in the predetermined position with an adhesive 618. The adhesive 618 is applied via an applicator 620 to the blade root 614 around the edges of the blade platform 616. However, the location of the adhesive 618 will be dependant on the configuration of the blade assembly.

The adhesive 618 can be applied during the assembly process. An advantageous window to apply the adhesive 618 is after the blades have been mounted in the disc and prior to the application of a protective coating balancing the blades which protects the blades from debris generated during the grinding process. Such a coating can be a wax based paint as is known in the art.

The adhesive 618 can be a high temperature adhesive so that it can remain in place during the operation of the engine. However, the skilled person will appreciate that if a low temperature adhesive is used, for example an epoxy resin, then it will burn off during the operation of the engine without any detrimental side effects.

If the adhesive is a high temperature adhesive then the whole rotor can be dipped or painted with a suitable solvent that will dissolve the high temperature adhesive when maintenance is required. The blades can then be removed in the normal manner. On rebuild, the process as shown above can be repeated.

The solutions provided by the invention ensure that the tip grinding process is repeatable and reliable and ensures that the tip margins expected from the grinding process are uniformly retained, regardless of whether the grinding process is interrupted.

The above embodiments are examples of the invention as defined by the following claims.

The invention claimed is:

1. A method of grinding a tip of a blade that forms part of a rotor for a gas turbine engine, comprising:

mounting a plurality of blades in a disc to provide a blade assembly;

mounting the blade assembly in a grinding apparatus;

aligning the plurality of blades in a predetermined position using compressed fluid; and grinding the blade tips, wherein each blade has a pressure surface and a suction surface, the compressed fluid is incident on either the pressure surface or the suction surface, the alignment of the blades is carried out while the blade assembly is rotated in the grinding apparatus, and the grinding apparatus comprises a nozzle in fluid communication with a source of the compressed fluid, wherein the nozzle can be adapted to project the compressed fluid onto each of a plurality of blades of the blade assembly so as to cause the aligning.

2. The method according to claim 1 wherein the compressed fluid is air.

3. The method according to claim 1 wherein a force applied to the blade is between approximately 1 and 20 N.

4. The method according to claim 1 wherein the grinding is carried out at a higher rotational speed than the rotational speed used during the alignment.

5. The method according to claim 1 wherein the compressed fluid is removed during the grinding.

6. A grinding apparatus for grinding a tip of a blade that forms part of a rotor for a gas turbine engine, the grinding apparatus comprising:

a mount for holding the rotor blade assembly;

an abrasive member for grinding the tip of the blade;

a nozzle in fluid communication with a source of compressed fluid, wherein the nozzle can be adapted to project the compressed fluid onto each of a plurality of blades of the blade assembly so as to position each blade in a predetermined position relative to the rotor blade assembly.

7. The grinding apparatus according to claim 6 wherein the nozzle can be adapted to project fluid onto a pressure surface or suction surface of the blade.

8. The grinding apparatus according to claim 7 wherein the compressed fluid is air.

* * * * *